US010239117B2

(12) United States Patent
Suzuki

(10) Patent No.: US 10,239,117 B2
(45) Date of Patent: Mar. 26, 2019

(54) CORE SAND REGENERATION SYSTEM

(71) Applicants: MATSUSHITA INDUSTRY CORP., Iwata, Shizuoka (JP); ENSHU IRON WORK'S CO., LTD., Iwata, Shizuoka (JP)

(72) Inventor: Hisashi Suzuki, Shizuoka (JP)

(73) Assignees: MATSUSHITA INDUSTRY CORP., Iwata, Shizuoka (JP); ENSHU IRON WORK'S CO., LTD., Iwata, Shizuoka (JP)

( * ) Notice: Subject to any disclaimer, the term of this patent is extended or adjusted under 35 U.S.C. 154(b) by 9 days.

(21) Appl. No.: 15/104,160

(22) PCT Filed: Mar. 25, 2016

(86) PCT No.: PCT/JP2016/059530
§ 371 (c)(1),
(2) Date: Jun. 13, 2016

(87) PCT Pub. No.: WO2017/090258
PCT Pub. Date: Jun. 1, 2017

(65) Prior Publication Data

US 2017/0326622 A1 Nov. 16, 2017

(30) Foreign Application Priority Data

Nov. 27, 2015 (JP) ..... 2015-231682
Jan. 27, 2016 (JP) ..... 2015-013869

(51) Int. Cl.
*B22C 5/00* (2006.01)
*F28D 11/02* (2006.01)
(Continued)

(52) U.S. Cl.
CPC ..... *B22C 5/00* (2013.01); *F23G 5/20* (2013.01); *F23G 7/14* (2013.01); *F28C 3/18* (2013.01); *F28D 11/02* (2013.01)

(58) Field of Classification Search
CPC .... B22C 5/00; B22C 5/04; B22C 5/10; F28D 11/02
(Continued)

(56) References Cited

U.S. PATENT DOCUMENTS 4,507,081 A 3/1985 Deve
2005/0279715 A1* 12/2005 Strong et al. ..... B01D 17/0211 210/774

FOREIGN PATENT DOCUMENTS

JP S56-117856 A 9/1981
JP 60-500945 A 6/1985
(Continued)

*Primary Examiner* — Kevin P Kerns
(74) *Attorney, Agent, or Firm* — Bacon & Thomas, PLLC

(57) ABSTRACT

A rotary kiln-type core sand regeneration system, having a rotating cylinder, a burner for directing a flame into the rotating cylinder, a motor for rotating the rotating cylinder, front and rear boundary frames and rollers for supporting the rotating cylinder, and a platform on which the rotating cylinder, the burner, the motor, the front and rear boundary frames and the rollers are mounted. The rotating cylinder has a used core sand inlet, an exhaust cylinder and a preliminary heating cylinder arranged from the rear and a regenerated core sand outlet formed at a front part thereof, the rotating cylinder being directly coupled to the burner at a front end, and including at least one combustion cylinder having passing holes through which the core sand and the flame from the burner are passed in a front part thereof.

13 Claims, 8 Drawing Sheets

(51) Int. Cl.

| | |
|---|---|
| ***F23G 5/20*** | (2006.01) |
| ***F23G 7/14*** | (2006.01) |
| ***F28C 3/18*** | (2006.01) |

(58) Field of Classification Search
USPC ..... 164/5, 158, 412, 456
See application file for complete search history.

(56) References Cited

FOREIGN PATENT DOCUMENTS

| | | | |
|---|---|---|---|
| JP | H04-125043 | U | 11/1992 |
| JP | H06-63691 | A | 3/1994 |
| JP | H06-170485 | A | 6/1994 |
| JP | H07-033432 | U | 6/1995 |
| JP | H08-243682 | A | 9/1996 |
| JP | 2010-075937 | A | 4/2010 |
| JP | 2013-146741 | A | 8/2013 |

* cited by examiner

FIG. 1
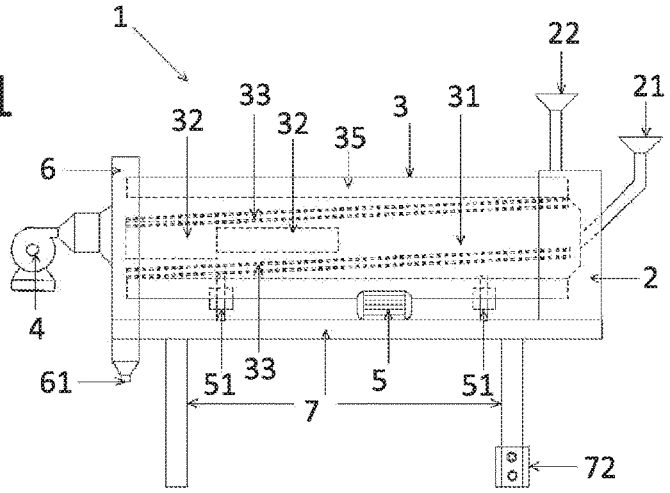
FIG. 2
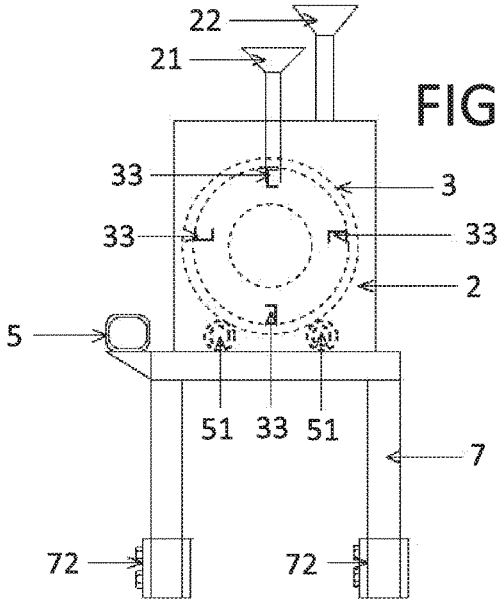
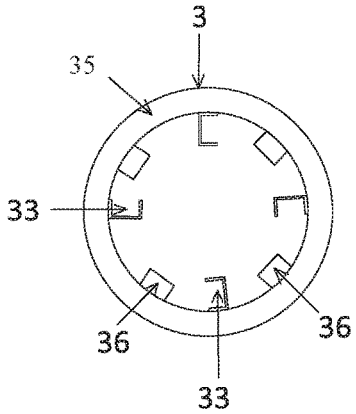
FIG. 3
FIG. 4
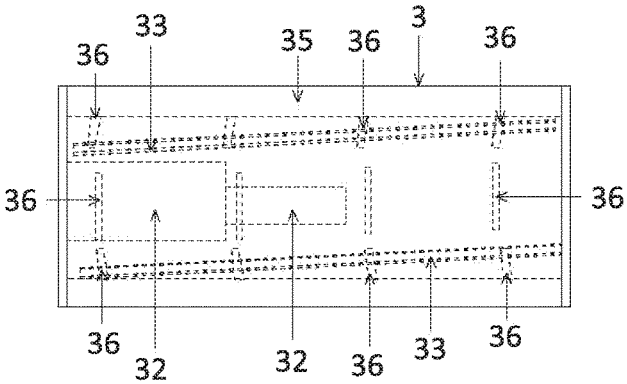

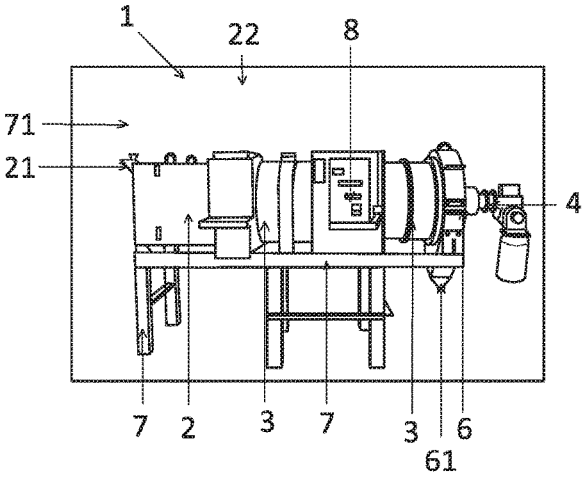
FIG. 7
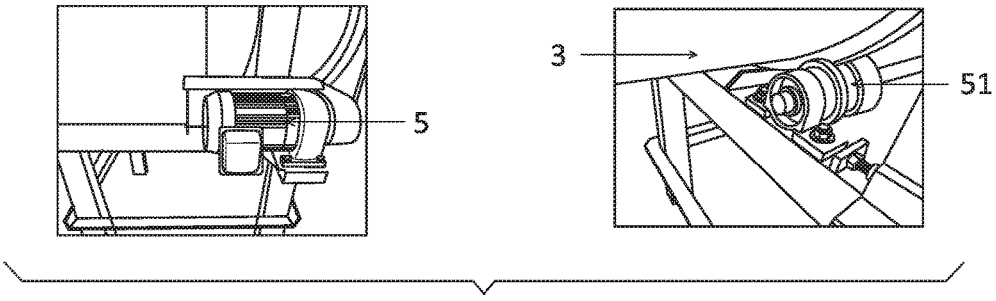
FIG. 8
FIG. 9
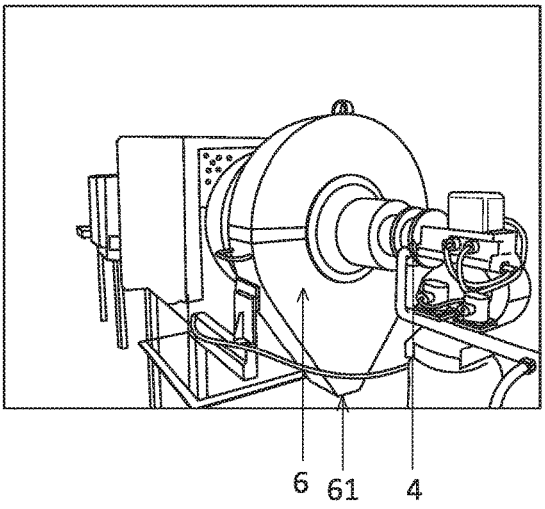

CORE SAND REGENERATION SYSTEM

The present invention relates to a system for regenerating used core sand.

BACKGROUND

A core, which is a sand mold that is inserted into a casting mold as a part corresponding to a cavity when, in particular, a casting having a complicated cavity therein is produced, is produced by packing sand into a mold. A complicated shape is formed by placing a core in a casting mold called main mold, casting a molten metal, such as iron, and solidifying it into a shape, and finally breaking the core. For example, because the melting temperature of iron is approximately 1500° C., sand with a special composition is used so that the core can withstand such high heat. After the product is half cooled, the core is broken by applying an impact and the sand is taken out. Thus, each core is expendable without exception. The sand used to form a core is limited to those of a predetermined type, size or the like, and the properties a core is required to have include: (a) having high heat resistance, (b) generating only a small amount of gas and having a gas drainage, (c) being excellent in sand collapsibility, and (d) being low in cost. Currently, the core sand is mainly imported from Australia.

A core is produced by putting a mixture of predetermined sand with a binding substance (which is hereinafter referred to as "binder") into a mold and shaping the sand by, for example, applying heat. Cores are expendable, and used cores are crushed and reduced to sand. However, because the sand used to form cores has to be of a predetermined type and particle size and has a relatively high unit price, the sand once used as a core needs to be recycled, in other words, regenerated. However, used core sand has a binder adhering to the surface thereof, and the adhering binder has to be removed in order to regenerate the used core sand. Methods for removal of the binder include a method using a mechanical or physical action and a method using combustion or the like as described later. There are organic and inorganic binders. Currently, organic binders are widely used, but the use of inorganic binders is increasing because of the effect of volatile organic compounds (VOC). Inorganic binders have a higher melting point and are therefore more difficult to remove than organic binders by a method of removing a binder by combustion. In a conventional core sand regeneration system, an inorganic binder sometimes causes formation of silicon threads between the sand particles that bring the sand into a condition that cannot be regarded as having been regenerated.

Many manufacturers of transportation machines are located and their peripheral technologies have been developed in the region where the inventor of this application lives. Under such environment, the inventor of this application has been engaging in the business of producing and selling what they call kneading mixers for stirring and mixing core sand and a binder, their related equipment and so on. In order to address the above problem, the inventor of this application manufactured a prototype of a system that can regenerate used core sand with inorganic binder as well as used core sand with an organic binder. The inventor of this application focused on the fact that inorganic binders have a higher melting point than organic binders, and took care so that the combustion temperature could be high, the surface of the crushed used core sand could be combusted uniformly and the used core sand cannot be exposed to the direct flame of the burner. Then, as a result of trial and error, the inventor of this application invented a rotary kiln-type core sand regeneration system and filed an application for a patent on 27 Nov. 2015 (Heisei 27) (JP Patent Application 2015-231682, which is hereinafter referred to as "prior application").

When produced and sold, and started to be used in core producing companies and so on, the rotary kiln-type core sand regeneration system according to the invention of the prior application attracted attention among the people in the industry who heard about the effect of it and came to see it. The inventor of this application heard voices from the people in the industry saying "We want a more compact core sand regeneration system because of the limited premises." or "We want a core sand regeneration system that can regenerate core sand in a shorter period of time and save energy." Thus, the inventor of this application invented an energy-saving, batch-type core sand regeneration system that can regenerate used core sand in a shorter period of time by downsizing the core sand regeneration system of the prior application and filed an application for a patent on 27 Jan. 2016 (Heisei 28) (JP Patent Application 2016-013869, which is hereinafter referred to as "later application). This application collects the inventions according to the prior application as first to sixth inventions and the inventions according to the later application as seventh to thirteenth inventions.

The following documents are found as related art documents relating to a core sand regenerate method:

- a regeneration method for regenerating used casting sand by breaking the casting mold after casting followed by crushing the used casting sand into individual sand particles, applying a mechanical impact to the sand particles sufficient to break the binding substance covering the outer surface thereof, washing the sand particles with water to remove substantially all the binding substance still adhering to the sand particles therefrom due to charge with static electricity (Patent Document 1);
- a casting sand regeneration method including a roasting step of roasting black sand to convert the uncombusted inorganic substance, such as bentonite, adhering to the surface of the black sand into a magnetic material, a scraping step of scraping the magnetic material layer off the surface of the black sand treated in the roasting step with grinding stones, and a magnetic separation step of separating the magnetic material scraped off in the scraping step from the black sand using magnetic force to obtain regenerated sand (Patent Document 2);
- a solution furnace for solution treatment of an aluminum cast casted using a mold provided with a sand core, including a first heat treatment furnace having an inlet through which a cast after casting and before sand removal is introduced, a second heat treatment furnace having a discharge port, a shutter provided between the first heat treatment furnace and the second heat treatment furnace, a cast transporting conveyer for transporting the cast from the inlet to the discharge port, and a sand transporting conveyer provided below the cast transporting conveyer in the first heat treatment furnace, the cast transporting conveyer having a cast carrying surface with a mesh-like structure so that the core sand resulting from collapse of the sand core can pass downward through it and fall onto the sand transporting conveyer (Patent Document 3); and
- a method for regenerating casting sand used in a production process characterized by including the steps of preparing a rotor and a drum located in the rotor and having a striking means, loading the drum with a batch amount of sand, exposing the sand to high-density striking, shear and friction forces, and adjusting the variable rotational speed of at least one of the drum and rotor to adapt the strength of the forces to the force necessary to wash quartz particles (Patent Document 4).

RELATED ART DOCUMENT

Patent Document

Patent Document 1: JP-A-Hei 8-243682
Patent Document 2: JP-A-Hei 6-170485
Patent Document 3: JP-A-2013-146741
Patent Document 4: JP-A-Hei 6-63691

Patent Document 1 and Patent Document 2 disclose a used casting sand regeneration method using a mechanical or physical action, which may have difficulties in regenerating the used casting sand depending on the type of the core sand or binder. Patent Document 3 discloses a solution furnace having a cast carrying surface with a mesh-like structure so that the core sand resulting from collapse of the sand core can pass downward through it and fall onto a sand transporting conveyer, and no specific method for regenerating used core sand is shown. Patent Document 4 discloses a casting sand regenerating method using a physical action, not a regeneration system using heat.

SUMMARY OF THE INVENTION

The problem to be solved by this application is to provide equipment that can efficiently regenerate used core sand using an inorganic or organic binder.

A first invention provides a rotary kiln-type core sand regeneration system, comprising a rotating cylinder, a burner for directing a flame into the rotating cylinder, a motor for rotating the rotating cylinder, front and rear boundary frames and rollers for supporting the rotating cylinder, and a platform on which the rotating cylinder, the burner, the motor, the front and rear boundary frames and the rollers are mounted, the rotating cylinder having a used core sand inlet, an exhaust cylinder and a preliminary heating cylinder arranged from the rear and a regenerated core sand outlet formed at a front part thereof, the rotating cylinder being directly coupled to the burner at a front end, the rotating cylinder having core sand scooping plates, attached to an interior surface thereof and slightly inclined downward and forward with respect to a horizontal plane, for scooping, lifting up and dropping, and dispersing core sand at the bottom of the rotating cylinder and transmitting it forward, and including at least one combustion cylinder having passing holes through which the core sand and the flame from the burner are passed in a front part thereof, wherein used core sand is introduced through the used core sand inlet into the rotating cylinder, transmitted forward through the preliminary heating cylinder in the rotating cylinder while being repeatedly scooped, lifted up and dropped, and dispersed by the core sand scooping plates, and transmitted to the regenerated core sand outlet after the binder adhering to the surface of the used core sand is combusted or fused in the combustion cylinder.

FIG. 1 and FIG. 2 show a front schematic view and a right side schematic view, respectively, of a rotary kiln-type core sand regeneration system 1. A rotating cylinder 3 is supported by a rear boundary frame 2, a front boundary frame 6 and rollers 51, and mounted on a platform 7. The rotation of a motor 5 rotates the rotating cylinder 3 via the rollers 51. In the longitudinal direction of the rotating cylinder 3, the part of a used core sand inlet 21 and the part of a regenerated core sand outlet 61 are defined as rear and front, respectively. The core sand is used core sand at the used core sand inlet 21, core sand being regenerated in the rotating cylinder 3, and regenerated core sand at the regenerated core sand outlet 61. It should be noted that FIG. 1 and FIG. 2 are schematic views and components connecting the motor and the rollers, such as a rotating shaft, are not shown (the same applies hereinafter). In the rotary kiln-type core sand regeneration system 1, the term "cylinder" as used in the rotating cylinder 3, combustion cylinder 32, exhaust cylinder 22 and preliminary heating cylinder 31 refers to a shape having a hollow interior. A cylinder has a lateral face and end faces extending perpendicular to the center line of the cylinder, and the region including either or both of the lateral face and the end faces may be referred to as "wall surface" or simply as "wall."

The used core sand introduced into the rotating cylinder 3 through the used core sand inlet 21 is heated in the preliminary heating cylinder 31 while being scooped, lifted up and dropped, and dispersed by core sand scooping plates 33 attached to an interior surface of the rotating cylinder 3 when the rotating cylinder 3 is rotated, and is transported forward by the core sand scooping plates 33 slightly inclined downward and forward with respect to a horizontal plane. While these processes are repeated, the core sand is transported toward the combustion cylinder 32, and passed through passing holes 34 of the combustion cylinder 32 or over the surface of the combustion cylinder 32 a plurality of times so that the binder adhering to the surface of the used core sand can be removed by combustion or fusion while the core sand is repeatedly scooped, lifted up and dropped, and dispersed by the core sand scooping plates 33. The core sand is then transported to the regenerated core sand outlet 61.

Having the core sand scooping plates 33 is one of the characteristics of the first invention. The core sand scooping plates 33 are provided in a linear fashion on an interior surface of the rotating cylinder 3 and slightly inclined downward and forward with respect to a horizontal plane of the rotating cylinder 3. The core sand scooping plates 33 have a U-shaped configuration, and the rotation of the rotating cylinder 3 causes the core sand scooping plates 33 to scoop, lift up and drop, and disperse the core sand at the bottom of the rotating cylinder 3. Although the used core sand has been already crushed, the individual small particles of the sand are sticky to touch because of the binder adhering to their surfaces. The used core sand with a binder adhering to its surface may be in the form of small clumps of sand. Thus, the rotation of the rotating cylinder 3 and the core sand scooping plates 33 are used to scoop, lift up and drop, and disperse the used core sand at the bottom of the rotating cylinder 3 to crush it into individual small particles. Then, the heat from a burner 4 is efficiently conducted to the surface of the core sand to cause the binder adhering to the surface to combust or fuse. While four core sand scooping plates 33 having a U-shaped cross-section are shown in FIG. 2, the shape of the core sand scooping plates 33 is not limited to the U-shape as long as they can scoop, lift up and drop, and disperse the core sand efficiently when the rotating cylinder 3 is being rotated, and the number of the core sand scooping plates 33 is not specifically limited either. Further, each core sand scooping plate 33 does not necessarily extend like a straight line from rear to front in the rotating cylinder 3 as shown in FIG. 1, and may be divided into short sections. It took approximately 20 minutes for the rotary kiln-type core sand regeneration system 1 to regenerate used core sand. Thus, in the prototype, the angle at which the core sand scooping plates 33 are inclined downward and forward with respect to a horizontal plane is approximately 5 degrees. However, the angle may be arbitrarily chosen. The period for regeneration of used core sand also depends on the type of the binder, and is not limited to approximately 20 minutes.

The reason for the rotary kiln-type is to use a kiln in which the substance to be heated is brought into direct contact with a fuel or heating gas and regenerate used core sand while the kiln is being rotated. Rotary kilns are used for the production of cement, incineration of waste, and so on. When the rotary kiln-type core sand regeneration system 1 is used, any organic binder can be removed by combustion, but finely granular silicon balls remain in the regenerated core sand in the case of an inorganic binder. However, the used core sand can be well reused as core sand even if the silicon balls remain.

A second invention provides the rotary kiln-type core sand regeneration system according to the first invention, in which core sand retaining plates for temporarily retaining the core sand are attached to the interior surface of the rotating cylinder.

FIG. 3 and FIG. 4 show a cross-sectional schematic layout view and a front schematic layout view, respectively, of the rotating cylinder 3 having core sand retaining plates 36 of the second invention attached to the interior surface thereof. In order to regenerate used core sand, the used core sand has to be repeatedly scooped, lifted up and dropped, and dispersed by the core sand scooping plates 33, and a predetermined amount of time as described above is required. Not all the core sand at the bottom of the rotating cylinder 3 is scooped by the core sand scooping plates 33 and some of the core sand remains at the bottom. The core sand retaining plates 36 are attached to the interior surface of the rotating cylinder 3 to retain the remaining core sand temporarily so that the remaining core sand can be lifted up and dropped by the rotation of the rotating cylinder 3, and scooped by the core sand scooping plates 33. The core sand retaining plates 36 are not elongated in contrast to the core sand scooping plates 33, and a plurality of core sand retaining plates 36 are provided generally perpendicular to the direction in which the core sand is transported between the core sand scooping plates 33 on the interior surface of the rotating cylinder 3. The core sand retaining plates 36 are generally perpendicular because they may be slightly inclined so that the core sand can be transported forward. The core sand retaining plates 36 may be U-shaped opening in a direction opposite the direction in which the core sand is transported, in other words, toward the rear, so that they can have such a shape that the core sand can be temporarily retained more easily, but their shape is arbitrary.

A third invention provides a rotary kiln-type core sand regeneration system according to the first or second invention, in which the at least one combustion cylinder having passing holes includes two or more combustion cylinders concentrically arranged in a multilayered fashion.

FIG. 5 is a schematic view of various types of combustion cylinders 32 and passing holes 34, and FIG. 6 is a schematic layout view of the burner 4 and the combustion cylinder 32. The passing holes 34 of the combustion cylinder 32 has not only a function of promoting complete combustion of the fuel from the burner 4 but also a function of combusting or fusing the binder adhering to the surface of the core sand by causing the core sand that is scooped, lifted up and dropped, and dispersed by the core sand scooping plates 33 to pass through the passing holes 34 thereof or bringing the core sand into contact with the surface thereof. It is believed that the effect of the combustion cylinder 32 increases when the combustion cylinder 32 is constituted of multiple, such as two or three, cylinders arranged concentrically, compared to a case of being constituted of one cylinder. In FIG. 6, the combustion cylinder 32 consists of a long small-diameter combustion cylinder and two short large-diameter combustion cylinders arranged separately and concentrically outside the long small-diameter combustion cylinder, and the combustion cylinder 32 has a double-layer structure. It should be noted that the burner 4 can use either a gas fuel or liquid fuel.

A fourth invention provides the rotary kiln-type core sand regeneration system according to any one of the first to third inventions, in which the rotating cylinder has an adjustable rotational speed.

The regeneration operation time for which the used core sand is scooped, lifted up and dropped, and dispersed and the binder is combusted or fused varies depending on the type or amount of adhesion of the binder. In the rotary kiln-type core sand regeneration system 1, the core sand scooping plates 33 attached to the interior surface of the rotating cylinder 3 are inclined slightly downward with respect to a horizontal plane from the rear to the front of the rotating cylinder 3 so that the used core sand can be transported forward. Thus, the regeneration operation time can be extended or shortened by increasing or decreasing the rotational speed of the rotating cylinder 3. The adjustment of the rotational speed is generally made, but not limited to, through a control panel 8 operatively connected to the motor 5.

A fifth invention is the rotary kiln-type core sand regeneration system according to any one of the first to fourth inventions, in which the rotating cylinder has an adjustable inclination angle.

The regeneration operation time can be changed by increasing or decreasing the rotational speed of the rotating cylinder 3 as in the fourth invention, but there may be a case where it is difficult to adjust the regeneration operation time only with it. Thus, a function of adjusting the inclination angle of the rotating cylinder 3 itself is provided. In FIG. 1, a height adjusting jig 72 for changing the inclination of the rotating cylinder 3 is attached to each rear leg of the platform 7.

A sixth invention provides the rotary kiln-type core sand regeneration system according to any one of the first to fifth inventions, in which a heat insulating material is provided on a wall surface of the rotating cylinder.

Because the temperature inside the combustion cylinder 32 of the rotary kiln-type core sand regeneration system 1 reaches approximately 700 to 800° C. and the temperature of the exterior wall of the rotating cylinder 3 accommodating the combustion cylinder 32 also becomes considerably high, the operators are liable to get burnt when they touch it. In addition, it is natural to provide heat insulation for energy efficiency. The rotating cylinder 3 has a double-wall structure consisting of an exterior wall and an interior wall, and a heat insulating material 35 is interposed between the exterior and interior walls. It should be noted that, in the rotary kiln-type core sand regeneration system 1, a temperature sensor, such as a thermocouple, may be provided in the rotating cylinder 3 so that the amount of fuel supplied to the burner 4 can be controlled to maintain the temperature in the rotating cylinder 3 within a set range based on a signal from the temperature sensor. In addition, because the temperature inside the rotating cylinder 3 reaches 700° C. to 800° C., a heat-resistant stainless steel is used for the interior wall of the rotating cylinder 3 and the combustion cylinder 32.

A seventh invention provides a batch-type core sand regeneration system, comprising a batch cylinder, a burner for directing a flame into the batch cylinder, a motor for rotating at least one combustion cylinder and a rotating cylinder provided in the batch cylinder, and a platform on which the batch cylinder, the burner and the motor are mounted, the batch cylinder having an exhaust cylinder, the batch cylinder having a first end face directly coupled to the burner and a second end face through which a rotating shaft operatively connected to the motor extends, the combustion cylinder and the rotating cylinder being concentrically attached to the rotating shaft in the batch cylinder, the rotating cylinder having core sand scooping plates attached to an interior surface thereof, wherein a series of operations including causing the core sand scooping plates attached to the rotating cylinder to scoop, lift up and drop, and disperse core sand introduced through a used core sand inlet formed through the batch cylinder and accumulated at the bottom of the batch cylinder by rotating the rotating shaft, and combusting and fusing the binder adhering to the surface of the used core sand in the combustion cylinder having passing holes, which is also being rotated by the rotation of the rotating shaft, is repeated for a predetermined period of time to regenerate the core sand, and the regenerated core sand is taken out of a regenerated core sand outlet formed through the batch cylinder.

As described above, the inventor of this application invented the batch-type core sand regeneration system according to the seventh invention because the inventor heard voices about the rotary kiln-type core sand regeneration system according to the first invention from the people in the industry saying "We want a more compact core sand regeneration system because of the limited premises." or "We want a core sand regeneration system that can regenerate core sand in a shorter period of time and save energy." The batch-type core sand regeneration system according to the seventh invention and the rotary kiln-type core sand regeneration system according to the first invention are the same in that a regeneration operation is employed in which the used core sand is passed through the passing holes of the combustion cylinder or over the surface of the combustion cylinder a plurality of times to remove the binder adhering to the surface of the used core sand by combustion or fusion while being repeatedly scooped, lifted up and dropped, and dispersed by the core sand scooping plates. However, the former batch-type core sand regeneration system is different from the rotary kiln-type core sand regeneration system, in which the used core sand is continuously introduced through the used core sand inlet into the rotating cylinder and is subjected to a core sand regeneration operation while being transported to the regenerated core sand outlet, in that a predetermined amount of used core sand is introduced through the used core sand inlet into the batch cylinder and the regenerated core sand is taken out of the regenerated core sand outlet of the batch cylinder after the regeneration operation is carried out for a predetermined period of time. Thus, the former batch-type core sand regeneration system is a smaller apparatus compared to the latter because the rotating cylinder and the core sand scooping plates are shortened, and the used core sand inlet and the regenerated core sand outlet are closed during the regeneration operation to save energy. The numerals attached to the names of the components and parts in the each drawing and photograph of the batch-type core sand regeneration system 10 in FIG. 14 through FIG. 21 have a 1 at the beginning for easy distinguishing from the numerals attached to the names of the components and parts of the rotary kiln-type core sand regeneration system except 1 attached to the rotary kiln-type core sand regeneration system and 10 attached to the batch-type core sand regeneration system (refer to the "Description of Reference Numerals"). However, when two items have the same name, they may be different in, for example, shape but are the same in function, use and so on.

The batch-type core sand regeneration system according to the seventh invention has the following structure. The term "cylinder" used as in the batch cylinder, combustion cylinder and rotating cylinder of the batch-type core sand regeneration system refers to a circular cylindrical shape having a hollow interior. A circular cylinder has a lateral face and end faces extending perpendicular to the center line of the circular cylinder, and the region including either or both of the lateral face and the end faces may be referred to as "wall surface" or simply as "wall." The center of the batch cylinder, combustion cylinder or rotating cylinder refers to the center of their end face. However, the exhaust cylinder is not necessarily limited to a circular cylinder.

FIG. 14 shows a schematic layout view of the batch-type core sand regeneration system 10. A batch cylinder 12 is fixed. A combustion cylinder 13 and a rotating cylinder 14 are concentrically attached to a rotating shaft 161 in the batch cylinder 12, and the combustion cylinder 13 and the rotating cylinder 14 are rotatable. The combustion cylinder 13 is attached inside the rotating cylinder 14. The combustion cylinder 13 has passing holes 131 to cause the core sand to pass through them and bring the combustion in a burner 15 close to complete combustion.

The rotating shaft 161, which extends through one end face of the batch cylinder 12, is supported by a rotational bearing 163, and the rotation of a motor 16 rotates the combustion cylinder 13 and the rotating cylinder 14 via a driving belt 162. The other end face of the batch cylinder 12 is directly coupled to the burner 15 via a combustion cover 151. The batch cylinder 12 is provided with an exhaust cylinder 121, a used core sand inlet 122, a regenerated core sand outlet 123, a thermocouple 171, and so on. In FIG. 14, the used core sand inlet 122 is not shown in order to show the layout inside the batch cylinder 12. The used core sand inlet 122 is, however, shown in FIG. 18. A heat insulating material 127 in FIG. 15 is shown as covering the entire batch cylinder 12. This is to ensure safety and increase energy efficiency. The combustion cover 151 is provided around the burner 15, and a heat insulating material is provided on the exterior walls of the combustion cover 151. In this way, heat insulation is provided without leaving any gap for the sake of safety (the same applies hereinafter).

Although the used core sand has been already crushed, the individual small particles of the sand are sticky to touch because of the binder adhering to their surfaces. The used core sand with a binder adhering to its surface may be in the form of small clumps of sand. When used core sand is introduced through the used core sand inlet 122 into the batch cylinder 12, the used core sand accumulates at the bottom of the batch cylinder 12. The core sand is scooped, lifted up and dropped, and dispersed by core sand scooping plates 141 attached to the rotating cylinder 14 when the rotating cylinder 14 is rotated. The dropped and dispersed core sand is passed through passing holes 131 of the combustion cylinder 13 heated by the burner 15 or over the surface of the combustion cylinder 13, and the binder adhering to the surface of the used core sand is removed by combustion or fusion. The core sand is then dropped again to the bottom of the batch cylinder and accumulated. The core sand is scooped by the core sand scooping plates 141 and the same procedure is repeated for a predetermined period of time until the binder adhering to the surface of the used core sand is removed. The core sand that accumulates at the bottom of the batch cylinder 12 is called core sand, not used core sand, because it contains core sand that have been repeatedly subjected to combustion or fusion until the binder is removed while being scooped, lifted up and dropped, and dispersed.

When the batch-type core sand regeneration system 10 according to the seventh invention is used, any organic binder can be removed by combustion, but inorganic binders remain as finely granular silicon balls in the regenerated core sand. However, it has been experimentally confirmed, just as in the case of the rotary kiln-type core sand regeneration system 1, that the used core sand can be well reused as core sand even if the silicon balls remain.

An eighth invention provides the batch-type core sand regeneration system according to the seventh invention, in which the center of the rotating cylinder is located on a vertical line passing through the center of the batch cylinder and a predetermined distance below the center of the batch cylinder so that the core sand scooping plates attached to the rotating cylinder cannot contact the bottom of the batch cylinder and the core sand can be efficiently scooped.

The rotating cylinder 14 and the combustion cylinder 13 are concentrically attached to the rotating shaft 161, and have a center 132 and a center 142, respectively, located on the center line of the rotating shaft 161. The diameters of the cross-sections of the combustion cylinder 13, the rotating cylinder 14 and the batch cylinder 12 increase in this order. Thus, if their centers are located at the same position, the core sand scooping plates 141 are located away from the bottom of the batch cylinder 12 and cannot scoop the core sand accumulated at the bottom of the batch cylinder 12 efficiently. On the other hand, contact of the core sand scooping plates 141 with the bottom surface of the batch cylinder 12 causes breakage of the core sand scooping plates 141. Thus, the rotating shaft 161 is located below a center 125 of the batch cylinder, and the center 142 of the rotating cylinder is located on a vertical line 126 passing through the center 125 of the batch cylinder and a predetermined distance below the center 125 of the batch cylinder. It should be noted that the combustion cylinder 13 is also attached to the rotating shaft 161, and the center 132 of the combustion cylinder is therefore also lowered by the predetermined distance.

FIG. 15 and FIG. 16 show a front schematic view and a cross-section schematic view, respectively, of the inside of the batch cylinder 12. The combustion cylinder 13 and the rotating cylinder 14 are attached to the rotating shaft 161, and the combustion cylinder 13 is directly coupled to the burner 15. The rotating cylinder 14 is attached outside the combustion cylinder and concentrically around the rotating shaft 161, and accommodated in the batch cylinder 12, which is fixed to a platform frame 18.

As shown in FIG. 16, the center 132 of the combustion cylinder and the center 142 of the rotating cylinder on the center line of the rotating shaft 161 are located on the vertical line 126 passing through the center of the batch cylinder 12 and a distance "L" below the center 125 of the batch cylinder in FIG. 16. A gap is formed between the bottom of the batch cylinder 12 and the rotating cylinder 14 so that the core sand scooping plates 141 attached to the rotating cylinder 14 can efficiently scoop the core sand without contacting the bottom of the batch cylinder 12. Because the inside of the batch cylinder 12 reaches 700° C. to 800° C., the distance "L" is determined in view of thermal expansion of the batch cylinder 12 and the rotating cylinder 14. It should be noted that while twelve core sand scooping plates 141 having a U-shaped configuration are attached to the rotating cylinder 14 in FIG. 16, the core sand scooping plates 141 has only to have a function of scooping, lifting up and dropping, and dispersing the core sand efficiently and do not necessarily have a U-shaped configuration. The number of the core sand scooping plates 141 attached to the rotating cylinder 14 is also arbitrary.

A ninth invention provides the batch-type core sand regeneration system according to seventh or eighth invention, in which the at least one combustion cylinder having passing holes in the batch cylinder includes two or more combustion cylinders concentrically attached to the rotating cylinder in a multilayered fashion.

The combustion cylinder 13 has passing holes 131, and has a function of removing the binder adhering to the surface of the used core sand when the core sand is passed through the passing holes 131 or brought into contact with the surface of the combustion cylinder 13 and a function of bringing the burner 15 close to complete combustion. In order to increase these functions, combustion cylinders 13 having passing holes 131 are attached concentrically around the rotating shaft 161 in the rotating cylinder 14 in a multilayered fashion. The reason for this is the same as that in the third invention.

A tenth invention provides the batch-type core sand regeneration system according to any one of the seventh to ninth inventions, in which the combustion cylinder and the rotating cylinder in the batch cylinder have an adjustable rotational speed.

The batch-type core sand regeneration system 10 can regenerate 50 Kg to 500 Kg of used core sand at a time when the capacities of the batch cylinder and so on are changed. There are organic and inorganic binders, and the used core sand can be efficiently regenerated when the rotational speed of the rotating cylinder 14 and the combustion cylinder 13 is changed based on the type of the binder. This is the reason why the rotational speed of the combustion cylinder 13 and the rotating cylinder 14 is changed. It should be noted that the rotational speed of the combustion cylinder 13 and the rotating cylinder 14 can be changed using a variable device (not shown) attached to the rotating shaft 161 even if the rotating shaft 161 is the same.

An eleventh invention provides the batch-type core sand regeneration system according to any one of the seventh to tenth inventions, in which the batch cylinder has an adjustable inside temperature.

As described above, there are many types of binders, and regeneration at an appropriate temperature is also important for removal of the binder adhering to used core sand. In FIG. 14, a thermocouple 171 is attached to an upper part of the batch cylinder 12. A signal from the thermocouple 171 is sent to a microcomputer (not shown) incorporated in a control panel 17 and the amount of fuel supplied to the burner 15 is adjusted based on its result. However, the adjustment of the temperature in the batch cylinder 12 is not necessarily achieved by this method and may be achieved by, for example, sequence control, as long as temperature control can be made.

A twelfth invention provides the batch-type core sand regeneration system according to any one of the seventh to eleventh inventions, in which the batch cylinder is equipped with a blast door.

The batch cylinder 12 is provided with the exhaust cylinder 121, which may accidentally explode and do harm to the operators and the surroundings because it is almost airtight and because the binder contains organic substances and so on. Thus, a blast door 124 is provided for the sake of safety.

A thirteenth invention provides the batch-type core sand regeneration system according to any one of the seventh to twelfth inventions, in which a heat insulating material is provided on a wall surface of the batch cylinder.

Because the inside of the batch cylinder 12 of the batch-type core sand regeneration system 10 reaches approximately 700 to 800° C. and the temperature of the outer surface of the batch cylinder 12 becomes considerably high, the operators are liable to get burnt when they touch it. In addition, it is natural to provide heat insulation for energy efficiency. The batch cylinder 12 has a double-wall structure consisting of an exterior wall and an interior wall, and the heat insulating material 127 is interposed between the exterior and interior walls. As described above, heat insulation is provided without leaving any gap for the sake of safety. The reason for this is the same as that in the sixth invention.

The first invention provides equipment that can efficiently regenerate used core sand using an inorganic or organic binder. In particular, the core sand scooping plates and the combustion cylinder provided in the rotating cylinder produce the effect. The second invention makes the action of the core sand scooping plates more efficient. The third invention has a beneficial effect on complete combustion of the burner and combustion or fusion of the binder adhering to the surface of the used core sand. The fourth invention can appropriately adjust the regeneration operation time based on the type of binder, and the fifth invention can adjust the regeneration operation time by changing the inclination angle of the rotating cylinder when the regeneration operation time is difficult to adjust only by the fourth invention. The sixth invention aims at safety of work, improvement of work environment, and energy saving.

The seventh invention provides equipment that can efficiently regenerate used core sand using an inorganic or organic binder. In particular, compared to the rotary kiln-type core sand regeneration system according to the prior application (JP Patent Application 2015-231682), the equipment requires less installation area, can save energy because the batch cylinder is airtight and emits less heat, and requires less production cost. The eighth to eleventh inventions aim at means for regenerating used core sand efficiently, and the twelfth and thirteenth inventions aim at safety, energy saving and so on.

BRIEF DESCRIPTION OF DRAWINGS

FIG. 1 is a front schematic view of a rotary kiln-type core sand regeneration system.

FIG. 2 is a right side schematic view of the rotary kiln-type core sand regeneration system.

FIG. 3 is a schematic layout view of a cross-section of the rotary kiln-type core sand regeneration system having a rotating cylinder provided with core sand retaining plates.

FIG. 4 is a schematic layout view, seen from the front, of the rotary kiln-type core sand regeneration system having a rotating cylinder provided with core sand retaining plates.

FIG. 7 is a photograph of a prototype of the rotary kiln-type core sand regeneration system.

FIG. 8 is a photograph of a motor and a roller for rotating a rotating cylinder of the rotary kiln-type core sand regeneration system.

FIG. 9 is a photograph of a front boundary frame and a burner of the rotary kiln-type core sand regeneration system.

DETAILED DESCRIPTION OF THE INVENTION

Figure 5:
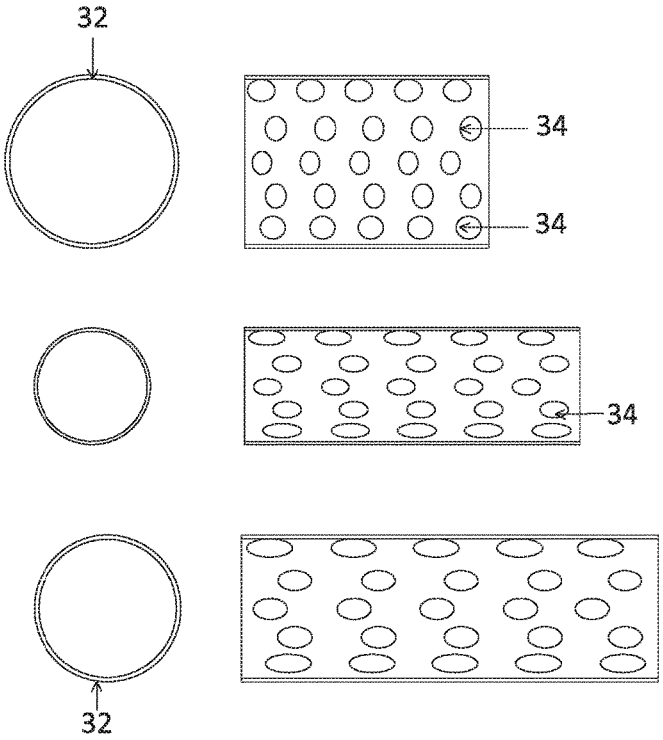
FIG. 5 is a schematic view of various combustion cylinders for the rotary kiln-type core sand regeneration system and their passing holes.
Figure 6:
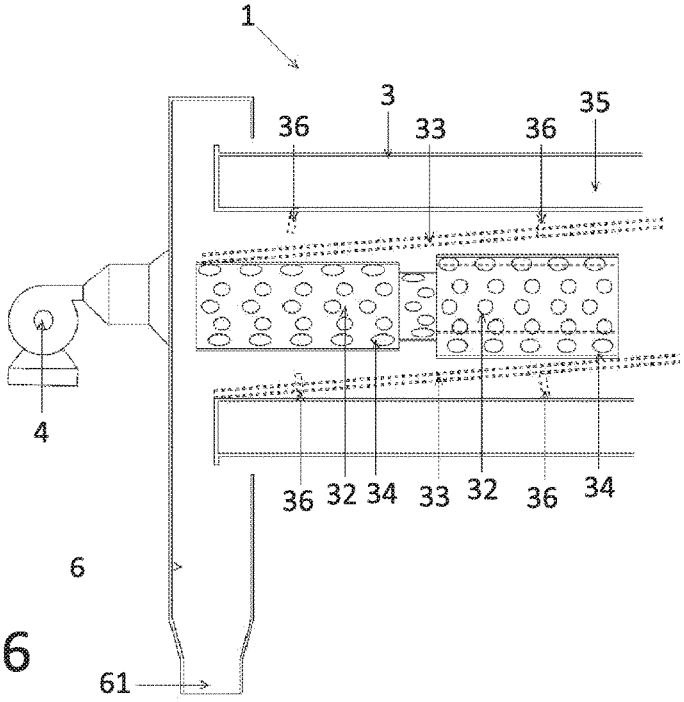
FIG. 6 is a schematic view of a burner and a combustion cylinder of the rotary kiln-type core sand regeneration system.

Examples of this application are shown below.

EXAMPLE 1

FIG. 1 through FIG. 13 are drawings and photographs of a rotary kiln-type core sand regeneration system 1. A prototype of the rotary kiln-type core sand regeneration system 1 is shown in FIG. 7. FIG. 7 is a view seen from the back side in contrast to the front schematic view of FIG. 1, and its front and rear are therefore inverted. Used core sand prepared in a hopper 71 is introduced into a rotating cylinder 3 in a rear boundary frame 2 through a used core sand inlet 21. The used core sand is passed through passing holes 34 of a combustion cylinder 32 or over the surface of the combustion cylinder 32 in the rotating cylinder 3 from the left side of FIG. 7 to the right side, where a burner 4 is located, while being repeatedly scooped, lifted up and dropped, and dispersed by core sand scooping plates 33 in the rotating cylinder 3, and the binder adhering to the surface of the used core sand is removed by combustion or fusion. The used core sand is then transported from inside of a front boundary frame 6 to a regenerated core sand outlet 61. A control panel 8 controls the start and stop of the core sand regeneration system, the rotational speed of the rotating cylinder 3, and so on. The system is mounted on a platform 7. Although not shown, a multiple dust removal device is located on the extension of an exhaust cylinder 22 to give consideration to the environment.

FIG. 8 shows photographs of a motor 5 and a roller 51 for rotating the rotating cylinder. Because the motor 5 is located on the left side toward the front on the platform, it is visible in FIG. 1 but not in FIG. 7. The torque of the motor 5 is transmitted to the rollers 51 to rotate the rotating cylinder 3. It should be noted that because a trademark was affixed to a part of the motor 5, that part was erased.

EXAMPLE 2

FIG. 9 is a layout photograph of the front boundary frame 6 and the burner 4. The regenerated core sand outlet 61 is located below the front boundary frame 6.

Figure 10:
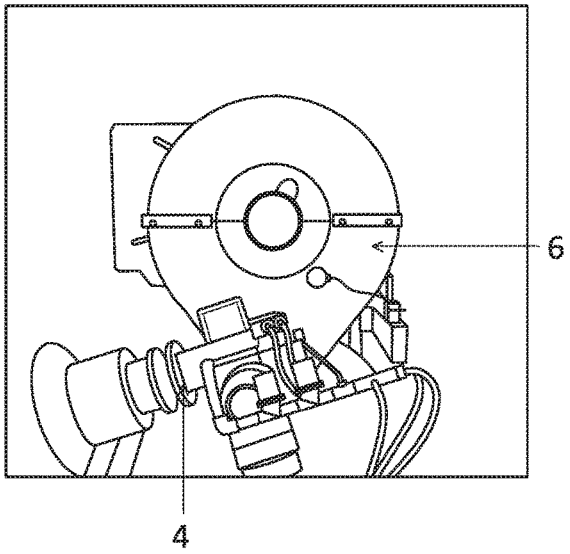
FIG. 10 is a photograph of the front boundary frame of the rotary kiln-type core sand regeneration system taken with the burner removed.
Figure 11:
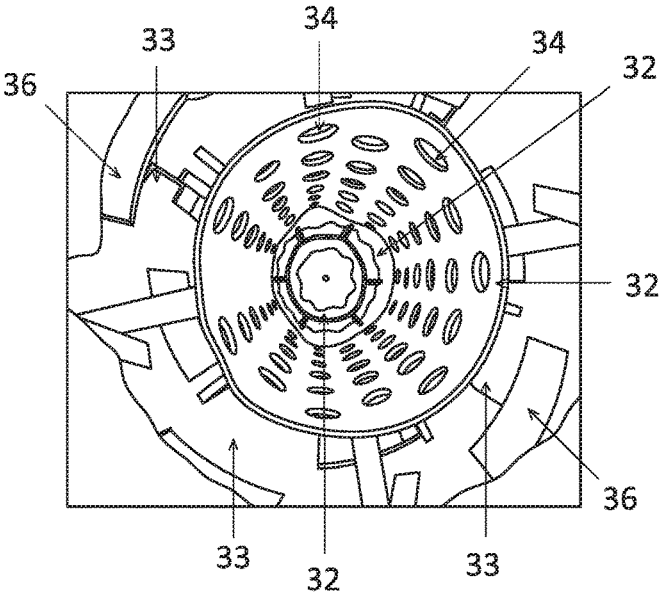
FIG. 11 is a photograph of the inside of the rotating cylinder of the rotary kiln-type core sand regeneration system as seen from the front boundary frame.
Figure 12A:
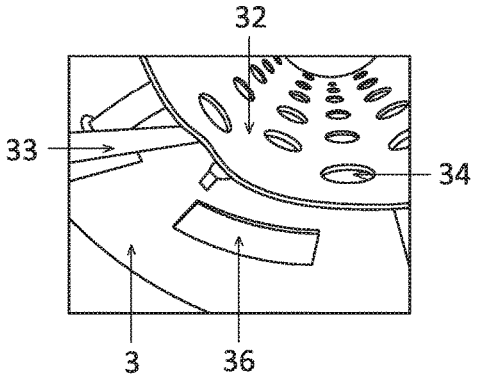
FIG. 12 shows photographs of the inside of the rotating cylinder as seen from the front boundary frame as in the case of FIG. 11.
Figure 12B:
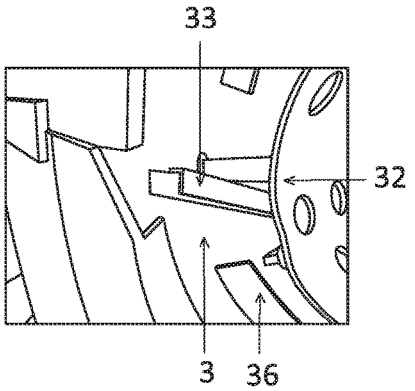

FIG. 10 is a photograph of the front boundary frame 6 taken with the burner 4 removed, and FIG. 11 is a photograph of the inside of the rotating cylinder 3 seen from the front boundary frame 6. The combustion cylinder 32 having the passing holes 34 is provided within the rotating cylinder 3. Further, FIG. 12 shows the layout of the core sand scooping plates 33 and core sand retaining plates 36 in the rotating cylinder 3. FIGS. 12A and 12B are photographs taken from different positions. A C-shaped steel is used as each core sand scooping plate 33, and a plurality of core sand scooping plates 33 extend from the rear to the front of the rotating cylinder 3. The core sand retaining plates 36 are perpendicularly fixed to the interior wall of the rotating cylinder 3, and a U-shaped member is used for each core sand retaining plate 36.

EXAMPLE 3

Figure 13A:
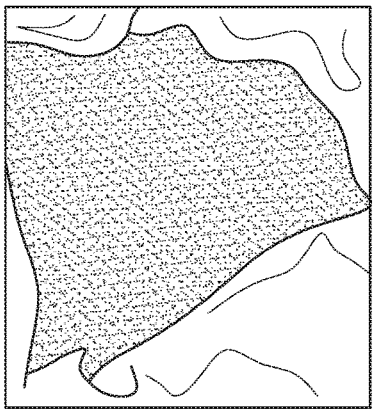
FIG. 13 shows photographs of used core sand and regenerated core sand that has been passed through the rotary kiln-type core sand regeneration system.
Figure 13B:
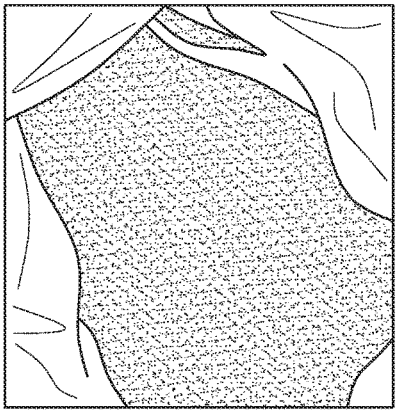
Figure 14:
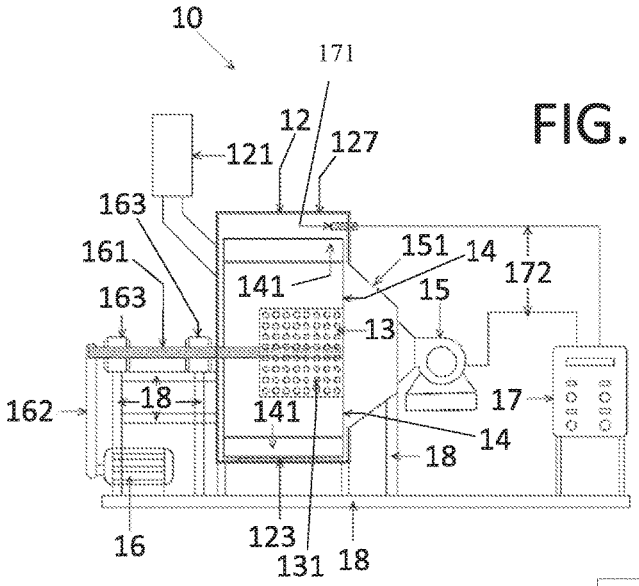
FIG. 14 is a schematic layout view of a batch-type core sand regeneration system.
Figure 15:
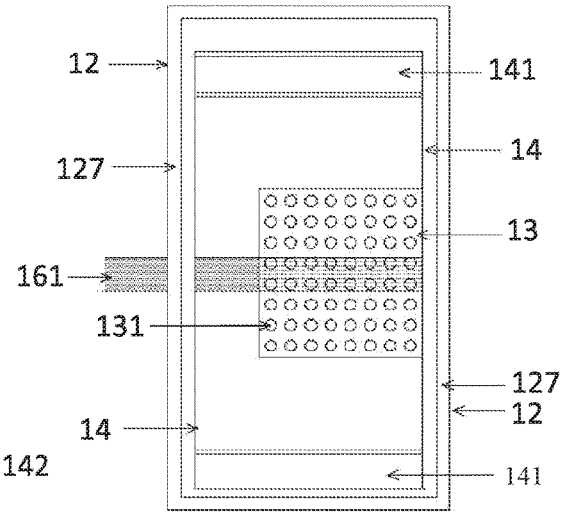
FIG. 15 is a front schematic view of the inside of a batch cylinder.
Figure 16:
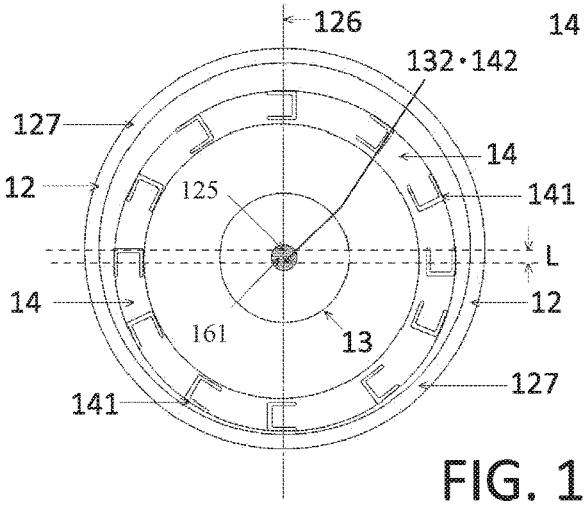
FIG. 16 is a cross-sectional schematic view of the inside of the batch cylinder.

FIGS. 13A and 13B show used core sand and regenerated core sand having been passed through the rotary kiln-type core sand regeneration system 1, respectively. Although their difference is not apparent from FIG. 13, it can be easily felt with fingers because the former is sticky whereas the latter is smooth.

EXAMPLE 4

Figure 17:
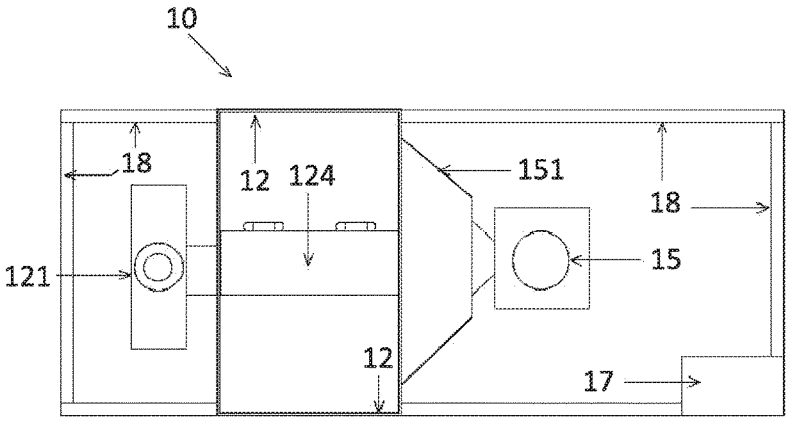
FIG. 17 is a basic plan view of the batch-type core sand regeneration system.
Figure 18:
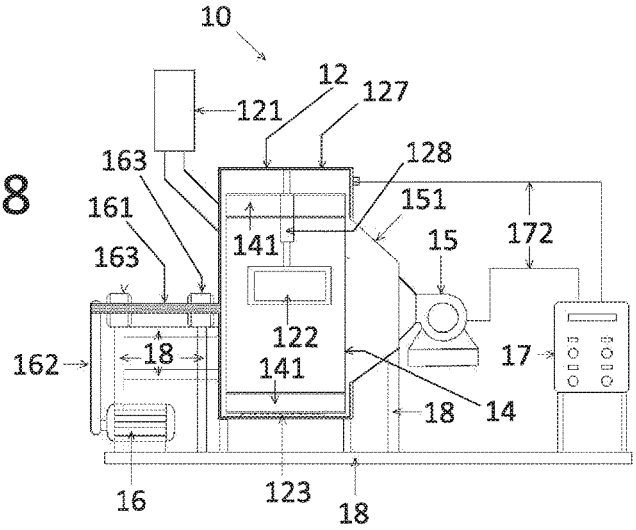
FIG. 18 is a basic front view of the batch-type core sand regeneration system.
Figure 19:
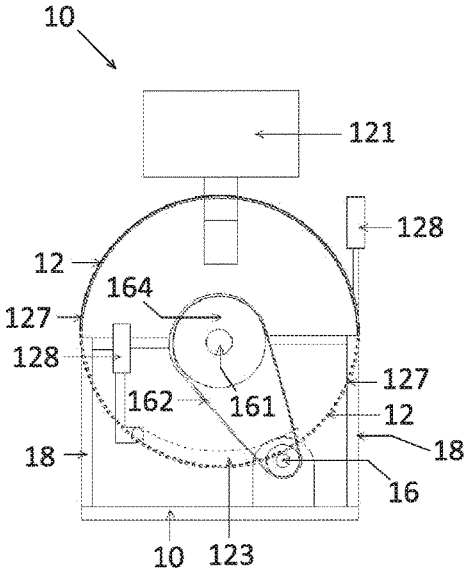
FIG. 19 is a basic left side view of the batch-type core sand regeneration system.

FIG. 14 through FIG. 19 are schematic views of a batch-type core sand regeneration system 10. FIG. 17 is a plan view, FIG. 18 is a front view, and FIG. 19 is a left side view. In FIG. 17, a blast door 124 is provided at an upper part of a batch cylinder 12. This is to prepare for accidental explosion of an organic solvent or the like to ensure safety because a binder containing the organic solvent and so on adheres to the surface of the used core sand and because the batch cylinder 12 is coupled to an exhaust cylinder 121 and is in an airtight state. A used core sand inlet 122 shown in FIG. 18 is opened and closed by an air cylinder 128 via a control panel 17. A regenerated core sand outlet 123 is also opened and closed by another air cylinder 128 via the control panel 17 as shown in FIG. 19. The rotation of a motor 16 rotates a sprocket 164 via driving belt 162, which rotates a rotating shaft 161 operatively connected thereto to rotate a combustion cylinder 13 and a rotating cylinder 14, thereby rotating the core sand scooping plates 141 attached to the rotating cylinder 14.

EXAMPLE 5

Figure 20:
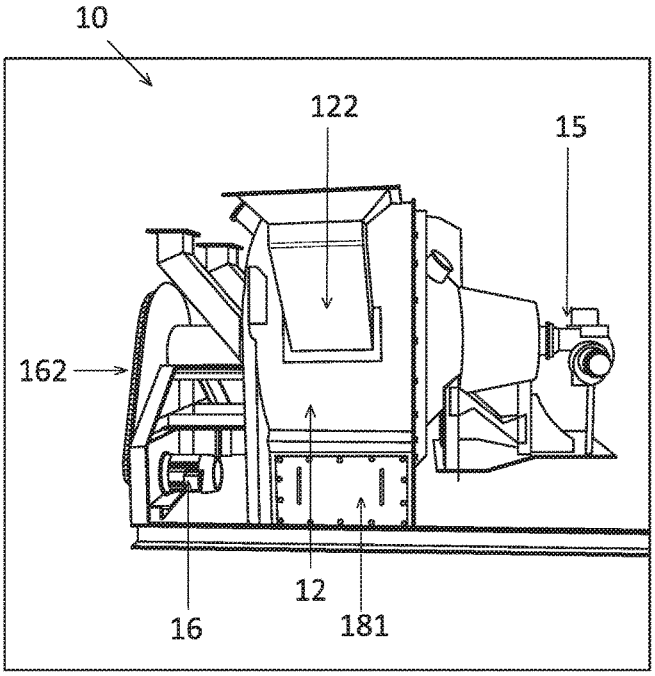
FIG. 20 is a front photograph of the batch-type core sand regeneration system in the course of trial production.
Figure 21:
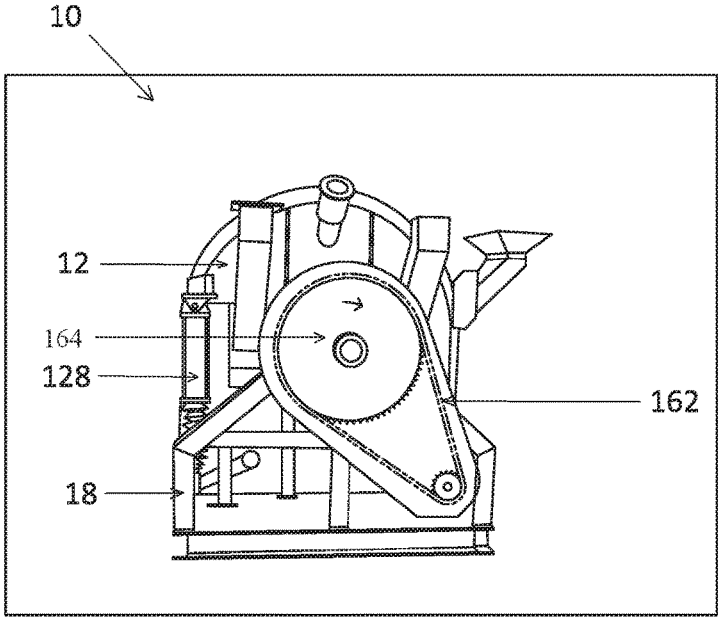
FIG. 21 is a left side photograph of the batch-type core sand regeneration system in the course of trial production.

FIG. 20 and FIG. 21 are photographs of a batch-type core sand regeneration system 10 in the course of trial production, and the exhaust cylinder 121, the control panel 17 and so on have yet to be attached. Compared to the rotary kiln-type core sand regeneration system 1 of the prior application (JP Patent Application 2015-231682), the batch-type core sand regeneration system 10 has an advantage of being small in size and occupying less space. In FIG. 20, an inspection opening 181 is provided outside the batch cylinder 12. In addition, as shown in FIG. 21, a chain is used as the driving belt 162. Because the inside of the batch cylinder 12 reaches 700° C. to 800° C., a heat-resistant stainless steel is used for the interior wall of the batch cylinder 12, the rotating cylinder 14, and the combustion cylinder 13.

The used core sand is crushed by a crusher (not shown), and collected into a primary tank (not shown). The used core sand is then weighed, and a predetermined amount of used core sand is stored in a pool tank (not shown). In the rotary kiln-type core sand regeneration system 1, the used core sand stored in the pool tank is continuously introduced into the used core sand inlet 21 and continuously regenerated. When the burner 4 is ignited and the combustion cylinder 32 and the rotating cylinder 3 are started to rotate, the core sand scooping plates 33 are rotated and a series of operations including scooping, lifting up and dropping, and dispersing the used core sand, and, at the same time, removing the binder adhering to the surface of the used core sand by combustion or fusion in the combustion cylinder 32 with passing holes 34, which is also being rotated, is repeated for a predetermined period of time. The resulting regenerated core sand is transported to the regenerated core sand outlet 61 and falls into a storage tank (not shown). In the batch-type core sand regeneration system 10, the used core sand inlet 122 is opened and a predetermined amount of used core sand is introduced into the batch cylinder 12. When the used core sand inlet 12 is closed, the burner 15 is ignited and the combustion cylinder 13 and the rotating cylinder 14 are started to rotate to rotate the core sand scooping plate 141. Then, a series of operations including scooping, lifting up and dropping, and dispersing the used core sand, and, at the same time, removing the binder adhering to the surface of the used core sand by combustion or fusion in the combustion cylinder 13 with passing holes 131, which is also being rotated, is repeated for a predetermined period of time. After maintaining the temperature inside the batch cylinder 12 at 700° C. or higher for 30 minutes, the rotation of the rotating shaft 161 is stopped, the regenerated core sand outlet 123 is opened and the regenerated core sand falls into a storage tank (not shown). The core sand regenerated in the rotary kiln-type core sand regeneration system 1 or the batch-type core sand regeneration system 10 is high in temperature and is therefore cooled by spraying water. This series of operations is performed automatically. The regenerated core sand is put into flexible container bags and delivered to core manufactures and so on. It should be noted that maintaining the temperature at 700° C. for 30 minutes is shown as examples of regenerate conditions, and the temperature and time conditions vary depending on the type of the binder.

INDUSTRIAL APPLICABILITY

A core is an indispensable technique for the production of precision components of transportation machines and so on, and the quality of core has a significant effect on the fuel efficiency. In addition to having proper particle size and composition, the individual particles of the core sand need to be round. Each core is expendable without exception, and used core sand needs regeneration. The core sand regeneration system of this application has the advantage of being able to regenerate used core sand using an inorganic binder. The rotary kiln-type core sand regeneration system can continuously regenerate used core sand, and the batch-type core sand regeneration system can regenerate core sand with different binders on a batch-by-batch basis. Because both are not complicated in structure in contrast to conventional used core sand regeneration systems, they can be offered at a low price and expected to be in high demand.

DESCRIPTION OF REFERENCE NUMERALS

1: rotary kiln-type core sand regeneration system

2: rear boundary frame, 21: used core sand inlet, 22: exhaust cylinder

3: rotating cylinder, 31: preliminary heating cylinder, 32: combustion cylinder, 33: core sand scooping plate

34: passing hole, 35: heat insulating material, 36: core sand retaining plate

4: burner

5: motor, 51: roller

6: front boundary frame, 61: regenerated core sand outlet

7: platform, 71: hopper, 72: (platform leg) height adjusting jig

8: control panel

10: batch-type core sand regeneration system

12: batch cylinder, 121: exhaust cylinder, 122: used core sand inlet

123: regenerated core sand outlet, 124: blast door

125: center of batch cylinder, 126: vertical line, 127: heat insulating material

128: air cylinder

13: combustion cylinder, 131: passing hole, 132: center of combustion cylinder

14: rotating cylinder, 141: core sand scooping plate, 142: center of rotating cylinder

15: burner, 151: combustion cover

16: motor, 161: rotating shaft, 162: driving belt

163: rotational bearing, 164: sprocket

17: control panel, 171: thermocouple, 172: communication line

18: platform frame, 181: inspection opening

It should be noted that the components and parts of the rotary kiln-type core sand regeneration system and the batch-type core sand regeneration system are named the same but designated by different numerals. This is for easy description of their differences and because this application is made by combining two patent applications filed in Japan into one patent application to claim for priority based thereon. When components or parts are named the same in both applications, they may be different in shape but are the same in function and use.

The invention claimed is:

1. A rotary kiln core sand regeneration system, comprising a rotating cylinder, a burner for directing a flame into the rotating cylinder, a motor for rotating the rotating cylinder, front and rear boundary frames and rollers for supporting the rotating cylinder, and a platform on which the rotating cylinder, the burner, the motor, the front and rear boundary frames and the rollers are mounted, the rotating cylinder having a used core sand inlet, an exhaust cylinder and a preliminary heating cylinder arranged from the rear and a regenerated core sand outlet formed at a front part thereof, the rotating cylinder being directly coupled to the burner at a front end, the rotating cylinder having core sand scooping plates, attached to an interior surface thereof and slightly inclined downward and forward with respect to a horizontal plane, for scooping, lifting up and dropping, and dispersing core sand at the bottom of the rotating cylinder and transmitting it forward, and including at least one combustion cylinder having passing holes through which the core sand and the flame from the burner are passed in a front part thereof, wherein used core sand is introduced through the used core sand inlet into the rotating cylinder, transmitted forward through the preliminary heating cylinder in the rotating cylinder while being repeatedly scooped, lifted up and dropped, and dispersed by the core sand scooping plates, and transmitted to the regenerated core sand outlet after the binder adhering to the surface of the used core sand is combusted or fused in the at least one combustion cylinder.

2. The rotary kiln-type core sand regeneration system according to claim 1, wherein core sand retaining plates for temporarily retaining the core sand are attached to the interior surface of the rotating cylinder.

3. The rotary kiln-type core sand regeneration system according to claim 1, wherein the at least one combustion cylinder having passing holes includes two or more combustion cylinders concentrically arranged in a multilayered fashion.

4. The rotary kiln-type core sand regeneration system according to claim 1, wherein the rotating cylinder has an adjustable rotational speed.

5. The rotary kiln-type core sand regeneration system according to claim 1, wherein the rotating cylinder has an adjustable inclination angle.

6. The rotary kiln-type core sand regeneration system according to claim 1, wherein a heat insulating material is provided on a wall surface of the rotating cylinder.

7. A batch core sand regeneration system, comprising a batch cylinder, a burner for directing a flame into the batch cylinder, a motor for rotating at least one combustion cylinder and a rotating cylinder provided in the batch cylinder, and a platform on which the batch cylinder, the burner and the motor are mounted, the batch cylinder having an exhaust cylinder, the batch cylinder having a first end face directly coupled to the burner and a second end face through which a rotating shaft operatively connected to the motor extends, the at least one combustion cylinder and the rotating cylinder being concentrically attached to the rotating shaft in the batch cylinder, the rotating cylinder having core sand scooping plates attached to an interior surface thereof, wherein a series of operations including causing the core sand scooping plates attached to the rotating cylinder to scoop, lift up and drop, and disperse core sand introduced through a used core sand inlet formed through the batch cylinder and accumulated at the bottom of the batch cylinder by rotating the rotating shaft, and combusting and fusing the binder adhering to the surface of the used core sand in the at least one combustion cylinder having passing holes, which is also being rotated by the rotation of the rotating shaft, is repeated for a predetermined period of time to regenerate the core sand, and the regenerated core sand is taken out of a regenerated core sand outlet formed through the batch cylinder.

8. The batch-type core sand regeneration system according to claim 7, wherein the center of the rotating cylinder is located on a vertical line passing through the center of the batch cylinder and a predetermined distance below the center of the batch cylinder so that the core sand scooping plates attached to the rotating cylinder cannot contact the bottom of the batch cylinder and the core sand can be efficiently scooped.

9. The batch-type core sand regeneration system according to claim 7, wherein the at least one combustion cylinder having passing holes in the batch cylinder includes two or more combustion cylinders concentrically attached to the rotating cylinder in a multilayered fashion.

10. The batch-type core sand regeneration system according to claim 7, wherein the at least one combustion cylinder and the rotating cylinder in the batch cylinder have adjustable rotational speeds.

11. The batch-type core sand regeneration system according to claim 7, wherein the batch cylinder has an adjustable inside temperature.

12. The batch-type core sand regeneration system according to claim 7, wherein the batch cylinder is equipped with a blast door.

13. The batch-type core sand regeneration system according to claim 7, wherein a heat insulating material is provided on a wall surface of the batch cylinder.

* * * * *